US011228146B2

(12) United States Patent
Wu et al.

(10) Patent No.: US 11,228,146 B2
(45) Date of Patent: Jan. 18, 2022

(54) POWER PLUG

(71) Applicant: DELTA ELECTRONICS, INC., Taoyuan (TW)

(72) Inventors: Kuan-Lung Wu, Taoyuan (TW); Ting-Yuan Yang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/918,885

(22) Filed: Jul. 1, 2020

(65) Prior Publication Data

US 2021/0175671 A1 Jun. 10, 2021

(30) Foreign Application Priority Data

Dec. 10, 2019 (TW) ..... 108145083

(51) Int. Cl.

| | |
|---|---|
| ***H01R 13/44*** | (2006.01) |
| ***H01R 13/66*** | (2006.01) |
| ***H01R 13/627*** | (2006.01) |
| ***H01R 13/512*** | (2006.01) |

(52) U.S. Cl.

CPC ..... *H01R 13/6675* (2013.01); *H01R 13/44* (2013.01); *H01R 13/512* (2013.01); *H01R 13/6271* (2013.01)

(58) Field of Classification Search

CPC .... H01R 13/74; H01R 13/743; H01R 13/748; H01R 2101/00; H01R 2201/14; H01R 2201/20; H01R 24/28; H01R 24/86; H01R 27/02; H01R 33/00; H01R 43/20; H01R 43/205; H01R 43/28; H01R 4/48

See application file for complete search history.

(56) References Cited

U.S. PATENT DOCUMENTS 4,121,880 A * 10/1978 Rollins ..... H01R 13/6395 24/16 PB
5,219,301 A * 6/1993 Frantz ..... H01R 13/6453 439/362
5,788,528 A * 8/1998 Orr, Jr. ..... H01R 13/6275 439/358

(Continued)

FOREIGN PATENT DOCUMENTS

TW M523220 U 6/2016
TW I550979 B 9/2016

OTHER PUBLICATIONS

Office Action dated Sep. 17, 2020 of the corresponding Taiwan patent No. I729616.

*Primary Examiner* — Truc T Nguyen
(74) *Attorney, Agent, or Firm* — Chun-Ming Shih; HDLS IPR Services

(57) ABSTRACT

The present invention provides an electrical connector, cables, an insulation sleeve, a latch member, and a fastener. One end of the electrical connector is provided with a coupling portion, and wiring holes are defined on the other end of the electrical connector opposite to the coupling portion. The cables are inserted in the wiring holes respectively. The insulation sleeve covers the junction of the electrical connector and each of the cables, and the coupling portion protrudes out of the insulation sleeve. The latch member is disposed corresponding to one side of the electrical connector. The fastener is disposed corresponding to the other side of the electrical connector.

16 Claims, 11 Drawing Sheets

(56) References Cited

U.S. PATENT DOCUMENTS

| | | | | | |
|---|---|---|---|---|---|
| 5,895,289 | A * | 4/1999 | Smith | H01R 13/743 | 439/553 |
| 6,004,163 | A * | 12/1999 | Behling | H01R 13/514 | 439/701 |
| 6,017,245 | A * | 1/2000 | Karir | H01R 13/506 | 439/607.45 |
| 6,083,031 | A * | 7/2000 | Kuo | H01R 13/6215 | 439/362 |
| 6,217,364 | B1 * | 4/2001 | Miskin | H01R 13/6275 | 439/358 |
| 7,648,384 | B2 * | 1/2010 | Desissard | H01R 13/5213 | 439/367 |
| 8,506,320 | B1 * | 8/2013 | Fu | H01R 13/6395 | 439/367 |
| 9,425,541 | B2 | 8/2016 | Data et al. | | |
| 2003/0032336 | A1 * | 2/2003 | Lazaro, Jr. | H01R 13/28 | 439/680 |
| 2003/0109169 | A1 * | 6/2003 | Ushiro | H01R 13/5816 | 439/468 |
| 2004/0137780 | A1 * | 7/2004 | Wu | H01R 13/6275 | 439/362 |
| 2005/0032411 | A1 * | 2/2005 | Gutgold | H01R 13/621 | 439/362 |
| 2006/0094281 | A1 * | 5/2006 | Dang | H01R 13/6275 | 439/352 |
| 2009/0246981 | A1 * | 10/2009 | Shmatovich | H01R 43/26 | 439/67 |
| 2011/0235977 | A1 * | 9/2011 | Yamada | G02B 6/383 | 385/76 |
| 2012/0282813 | A1 * | 11/2012 | Ballard | H01R 13/506 | 439/638 |

* cited by examiner

POWER PLUG

BACKGROUND OF THE INVENTION

Field of the Invention

The present invention generally relates to a power plug and, in particular to a power plug with fast coupling structure for high-current and high-voltage.

Description of Related Art

At present, the wiring method of high-current and high-voltage power plugs with quick couplings is mostly assembled by using cables connected to metal terminals and then inserting in plastic shells. However, this wiring method has safety concerns due to exposed cables.

Moreover, current power plugs are only fixed by plastic shells while inserting with corresponding sockets without other fixing means. Because the cable used for high current and high voltage usually has a thick diameter so that it has considerable weight and the junction of the current power plug is not stable. Thus, it is difficult to bear the weight of the cable and will be easy to loosen.

In view of the above drawbacks, the Inventor proposes the present invention based on his expert knowledge and elaborate researches in order to solve the problems of prior art.

SUMMARY OF THE INVENTION

Accordingly, an object of the present invention is to provide a power plug for high current and high voltage.

In order to achieve the object mentioned above, the present invention provides a power plug including an electrical connector, a plurality of cables, an insulation sleeve, at least one latch member and at least one fastener. One end of the electrical connector has a coupling portion and a plurality of wiring holes are defined on the other end of the electrical connector opposite to the coupling portion. Each of the cables has one end inserted in each of the wiring holes. The insulation sleeve covers the junction of the electrical connector and each of the cables, and the coupling portion protrudes out of the insulation sleeve. The latch member is disposed corresponding to one side of the electrical connector. The fastener is disposed corresponding to another side of the electrical connector.

The power plug of the present invention has provided the latch member disposed on the side of the electrical connector and the fastener disposed on the side of the insulation sleeve. Each fastener includes a base and a screw penetrating the base, and the base is formed on the side of the electrical connector. The latch member includes a resilience arm; one end of the resilience arm is connected to the side of the electrical connector and rest parts of the resilience arm are spaced from the side of the electrical connector, and a hook is formed at the other side of the resilience arm.

The power plug of the present invention has provided the fastener disposed on the side of the electrical connector and the latch member connects the side of the insulation sleeve. Each fastener includes a base and a screw penetrating the base, and the base is formed on the side of the insulation sleeve. The latch member includes a resilience arm; one end of the resilience arm is connected to the side of the insulation sleeve and rest parts of the resilience arm are spaced from the side of the electrical connector, and a hook is formed at the other side of the resilience arm.

The power plug of the present invention has provided the latch member connected to the side of the electrical connector and the fastener disposed on one side of the electrical connector. Each fastener includes a base and a screw penetrating the base, and the base is formed on the side of the electrical connector. The latch member includes a resilience arm; one end of the resilience arm is connected to the side of the electrical connector and rest parts of the resilience arm are spaced from the side of the electrical connector, and a hook is formed at the other side of the resilience arm.

The power plug of the present invention has provided the latch member connected to the side of the insulation sleeve and the fastener disposed on one side of the insulation sleeve. Each fastener includes a base and a screw penetrating the base, and the base is formed on the side of the insulation sleeve. The latch member includes a resilience arm; one end of the resilience arm is connected to the side of the insulation sleeve and rest parts of the resilience arm are spaced from the side of the electrical connector, and a hook is formed at the other side of the resilience arm.

The power plug further includes a fixture; the fixture clamps the electrical connector and each of the cables. The insulation sleeve covers the fixture.

Each of the cables is bended to form a corner, and each of the corners is shaped and covered by the insulation sleeve.

Each of the cables has a portion protruding out of the insulation sleeve and bundled with a binding layer.

The power plug has the insulation sleeve formed by injection molding to fix junctions of the electrical connector and the cables for insulation. At the same time, the insulation can also fix the bend of the cables.

BRIEF DESCRIPTION OF DRAWINGS

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
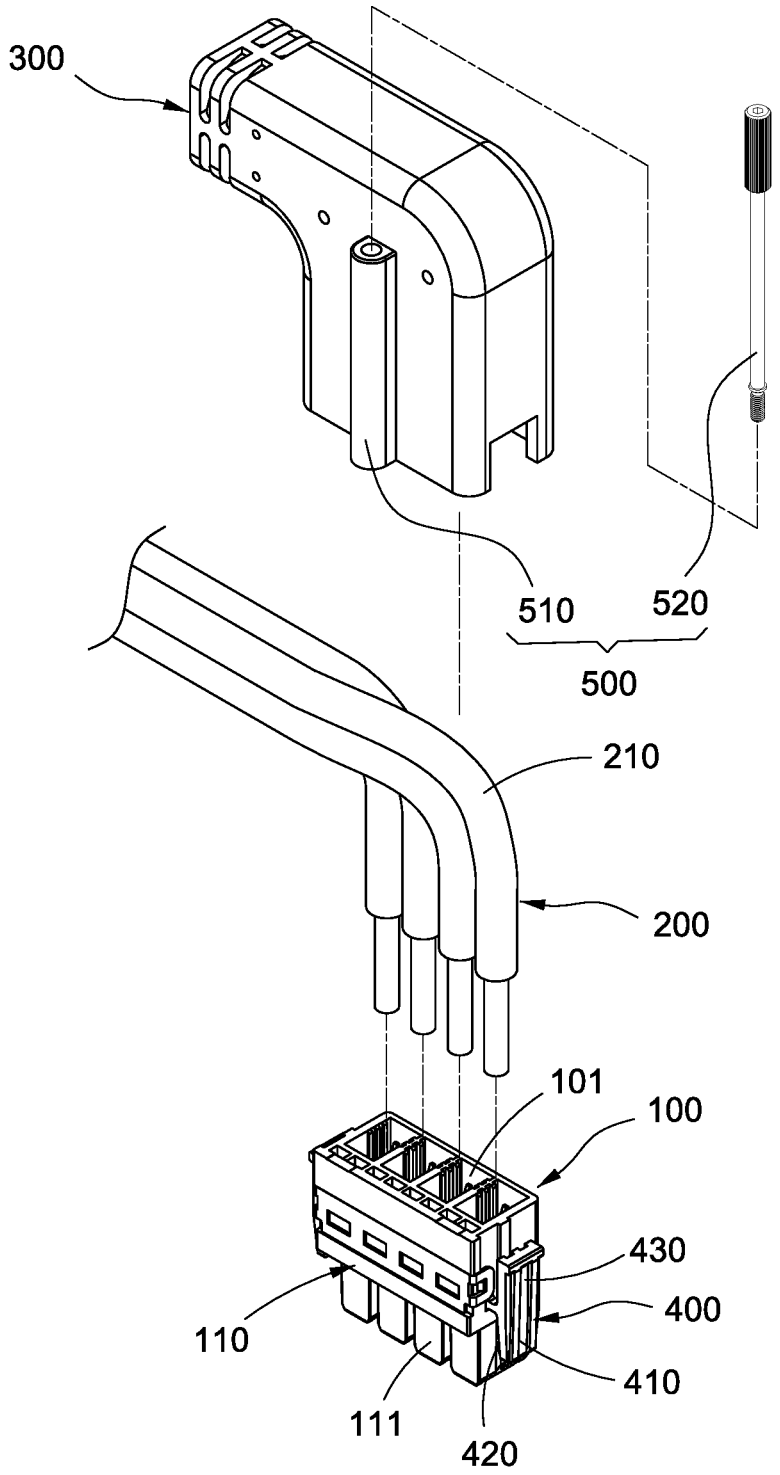
FIG. 1 is a perspective explosion schematic view of the power plug of the first embodiment of the present invention.
Figure 2:
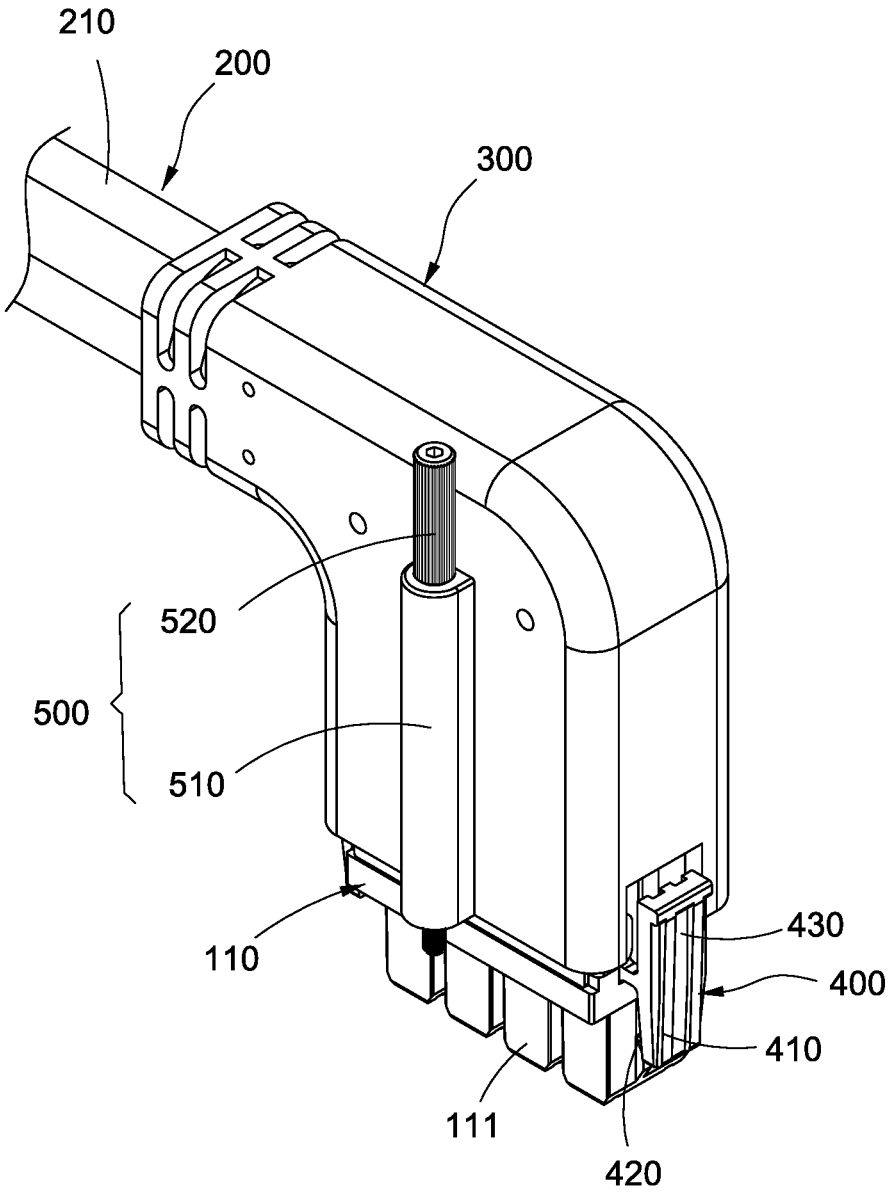
FIG. 2 is a perspective schematic view of the power plug of the first embodiment of the present invention.
Figure 3:
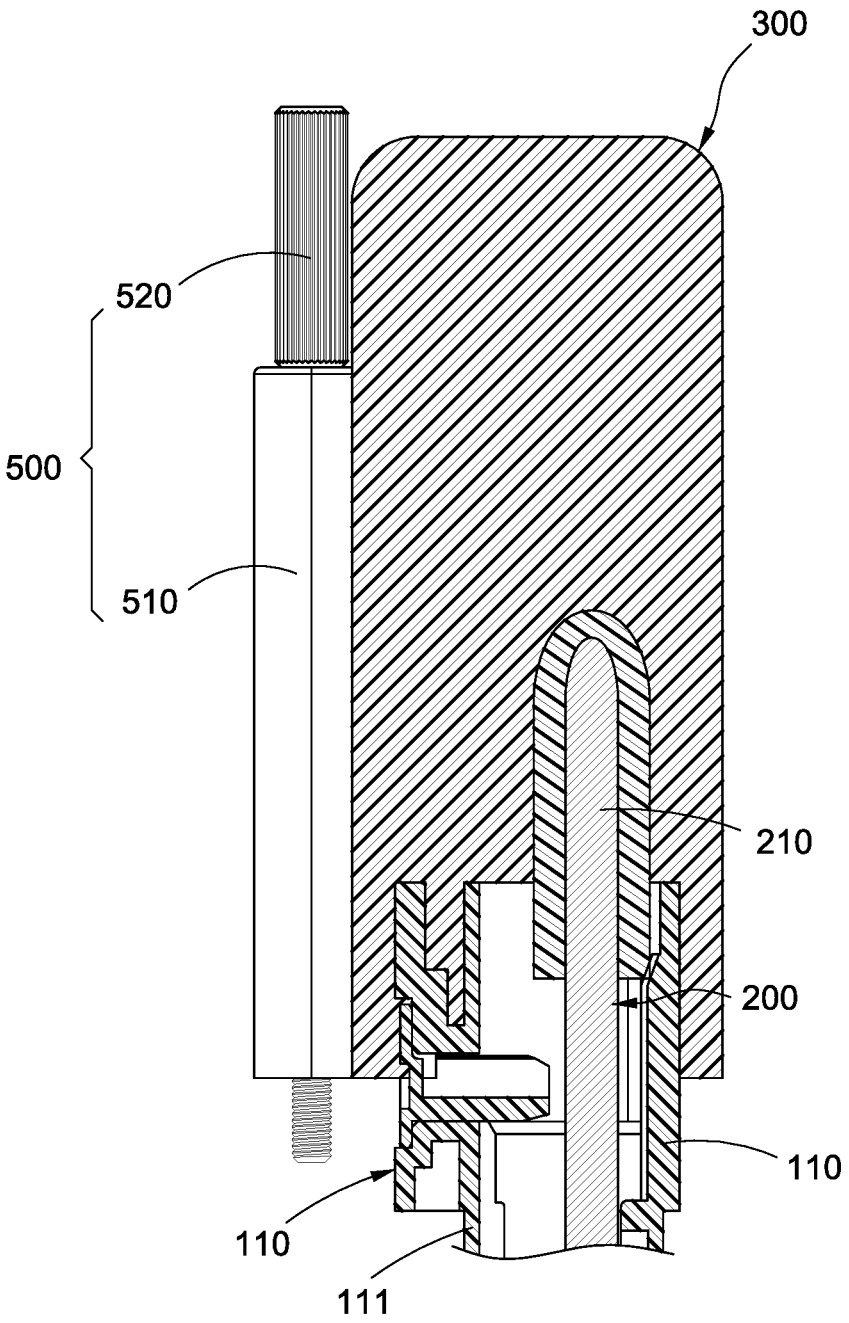
FIG. 3 is a cross sectional view of the power plug of the first embodiment of the present invention.

Please refer to FIG. 1 to FIG. 3. The first embodiment of the present invention provides a power plug including an electrical connector 100, a plurality of cables 200, an insulation sleeve 300, at least one latch member 400 and at least one fastener 500. The electrical connector 100 has an insulation seat 110, and the insulation seat 110 is preferably made of, but not limited to, plastic. One end of the insulation seat 110 has a coupling portion 111 and a plurality of wiring holes 101 defined on the other end of the insulation seat 110 opposite to the coupling portion 111. Each of the cables 200 has one end inserted in each of the wiring holes 101 respectively.

The insulation seat 110 connected with the cables 200 is placed in a mold and an insulation sleeve 300 is formed thereon by injection molding. Thus, the insulation sleeve 300 covers the junction of the electrical connector 100 and each of the cables 200. The coupling portion 111 protrudes out of the insulation sleeve 300, and each of the cables 200 is extended out the insulation sleeve 300 separately. The cable 200 for high current and high voltage has a thick diameter that makes it difficult for users to bend. Therefore, according to demands of using, the cables 200 can be bended to form a corner 210, and the corner 210 is shaped and covered by the insulation sleeve 300. Moreover, the cable 200 has a portion protruding out of the insulation sleeve 300 and bundled into a cable harness (not shown) with a binding layer (not shown).

The latch member 400 is disposed corresponding to the side of the electrical connector 100. In the present embodiment, a pair of identical latch members 400 are provided corresponding to the opposite sides of the electrical connector 100, however, the quantity of latch members 400 is not limited in the present invention. The fastener 500 is disposed corresponding to at least another other side of the electrical connector 100 which is not provided with a latch member 400, and the quantity of fasteners 500 is not limited in the present invention. In the embodiment, the power plug of the present invention has the latch member 400 connected to the side of the electrical connector 100 and the fastener 500 disposed on one side of the insulation sleeve 300.

Specifically, each fastener 500 includes a base 510 and a screw 520 penetrating the base 510, and the base 510 is formed on the side of the electrical connector 100. When the insulation base 110 is inserted in the corresponding socket, the screw 520 can be locked to the socket or an adjacent structure near the socket to fix the electrical connector 100.

Specifically, the latch member 400 includes a resilience arm 410. One end of the resilience arm 410 is connected to the side of the electrical connector 100, and rest parts of the resilience arm 410 are spaced from the side of the electrical connector 100, and a hook 420 is formed at the other side of the resilience arm 410. When the insulation base 110 is inserted in a corresponding socket, the hook 420 of the latch member 400 can be fastened with the socket to fix the electrical connector 100. Moreover, the resilience arm 410 can be extended to form a push handle 430 for the user to push. When the push handle 430 is pushed, the resilience arm 410 can be driven to release the hook 420.

Figure 4:
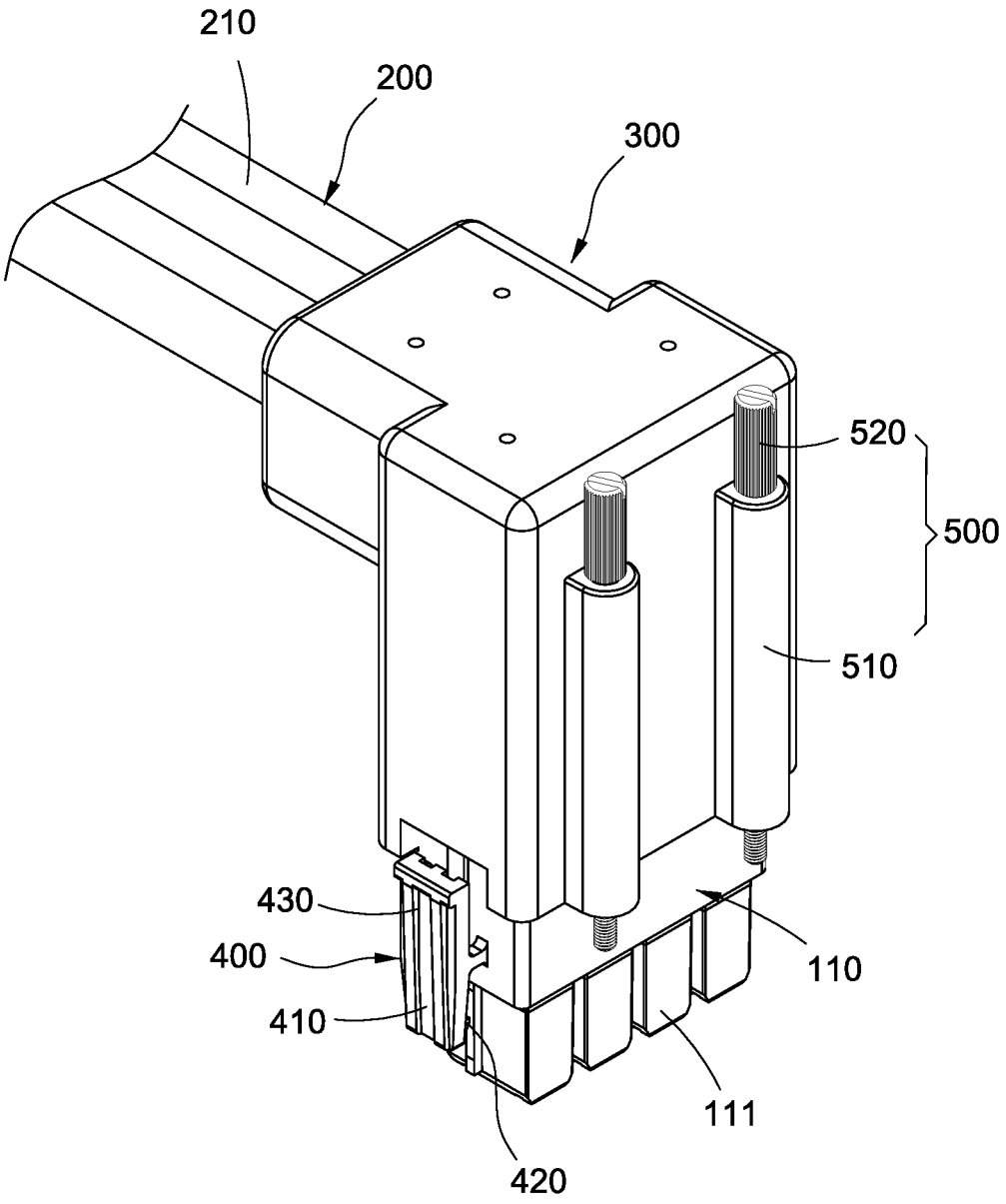
FIG. 4 and FIG. 5 are other schematic views of the power plug of the first embodiment of the present invention.
Figure 5:
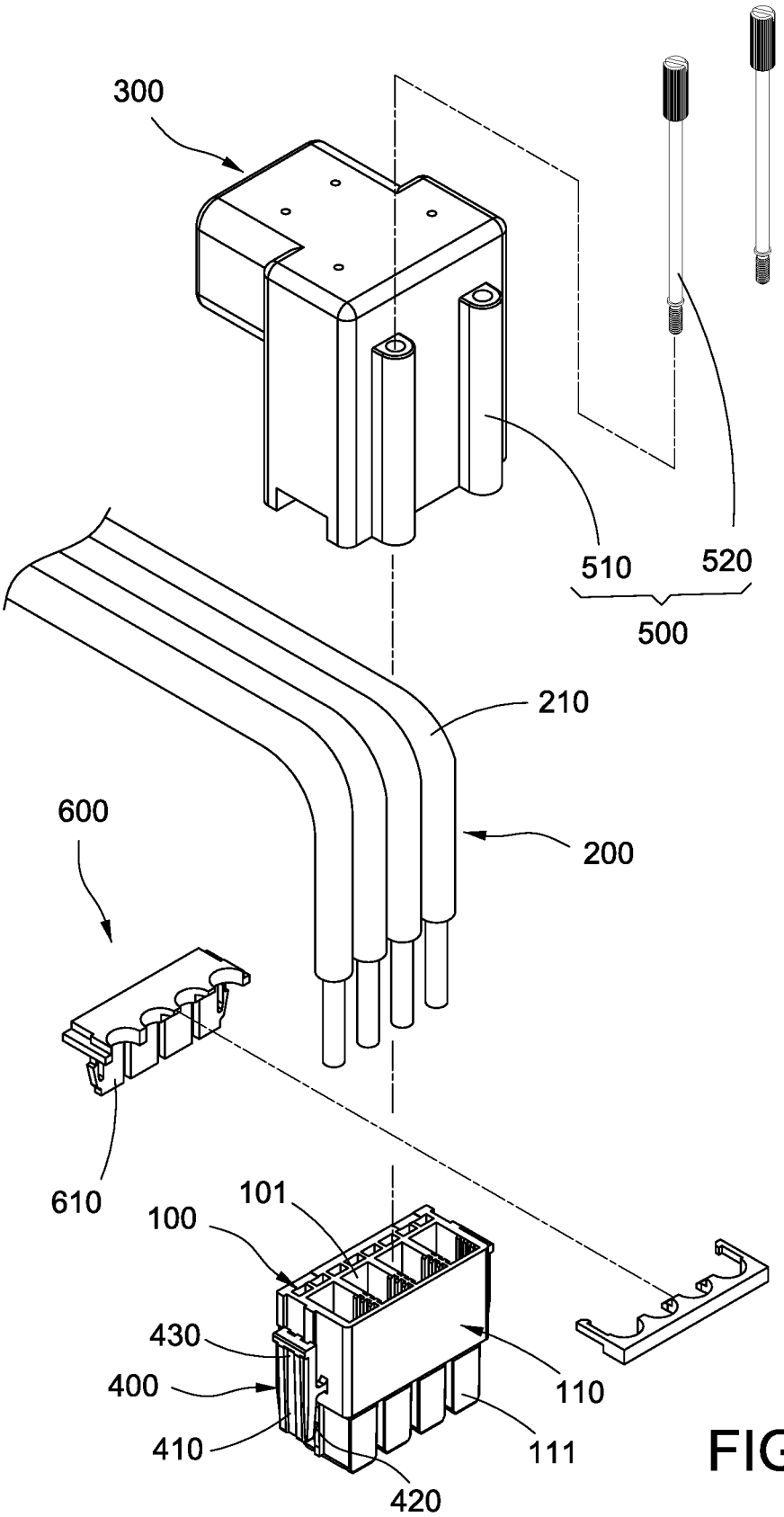

With referring to the FIG. 4 and the FIG. 5, according to demands of using, the cables 200 can be bended to form a variety of corners 210. Moreover, in the present embodiment, the power plug of the present invention further includes a fixture 600. The fixture 600 is extended to form a tenon 610. The tenon 610 is inserted into the insulation base 110 to fix the fixture 600 to the electrical connector 100, and the fixture 600 clamps each of the cables 200. The fixture 600 can be used to fix the junctions of the cables 200 and the insulation base 110 in advance before forming the insulation sleeve 300, and then the insulation sleeve 300 can be formed by injection molding, in addition, the insulation sleeve 300 covers the fixture 600.

Figure 6:
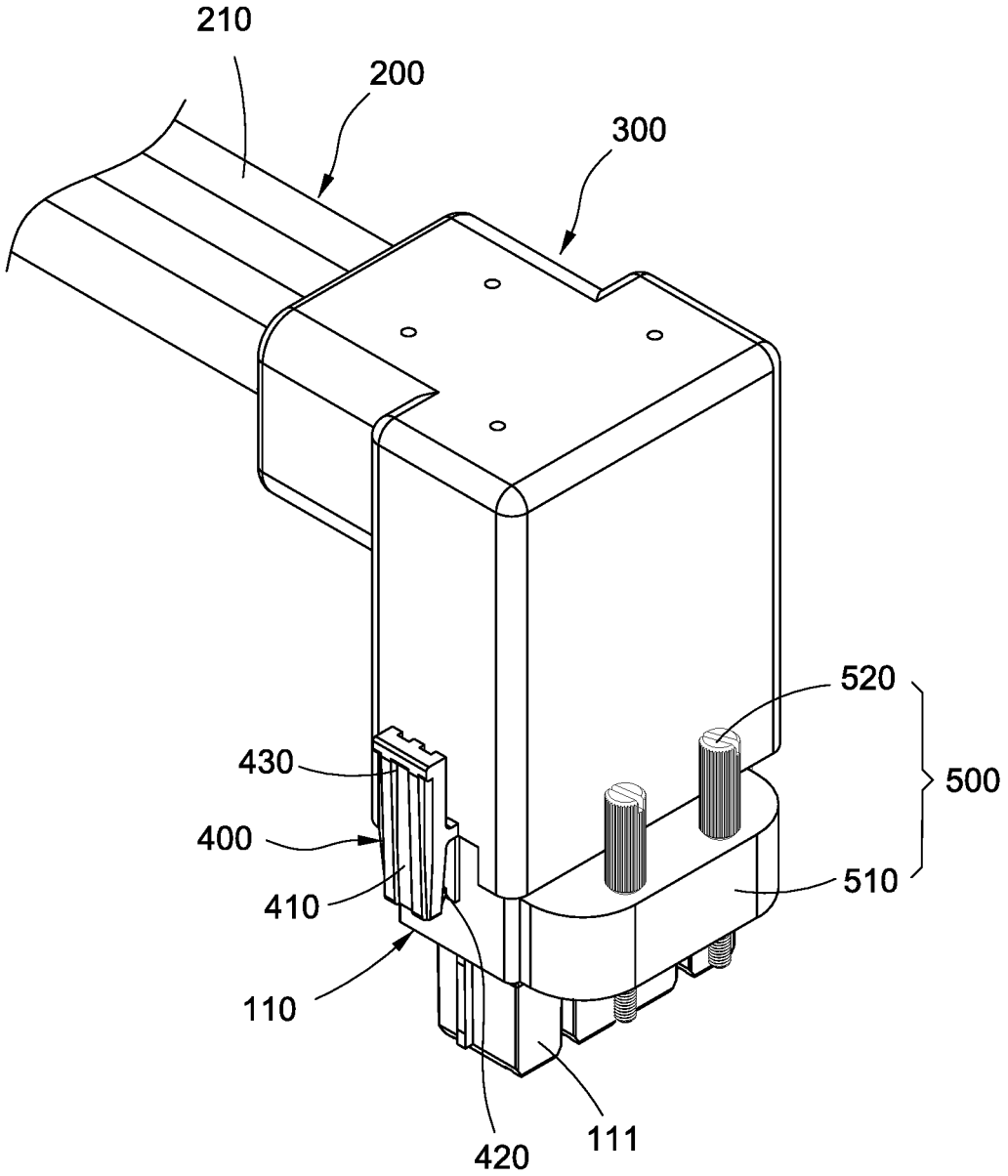
FIG. 6 is a perspective explosion schematic view of the power plug of the second embodiment of the present invention.
Figure 7:
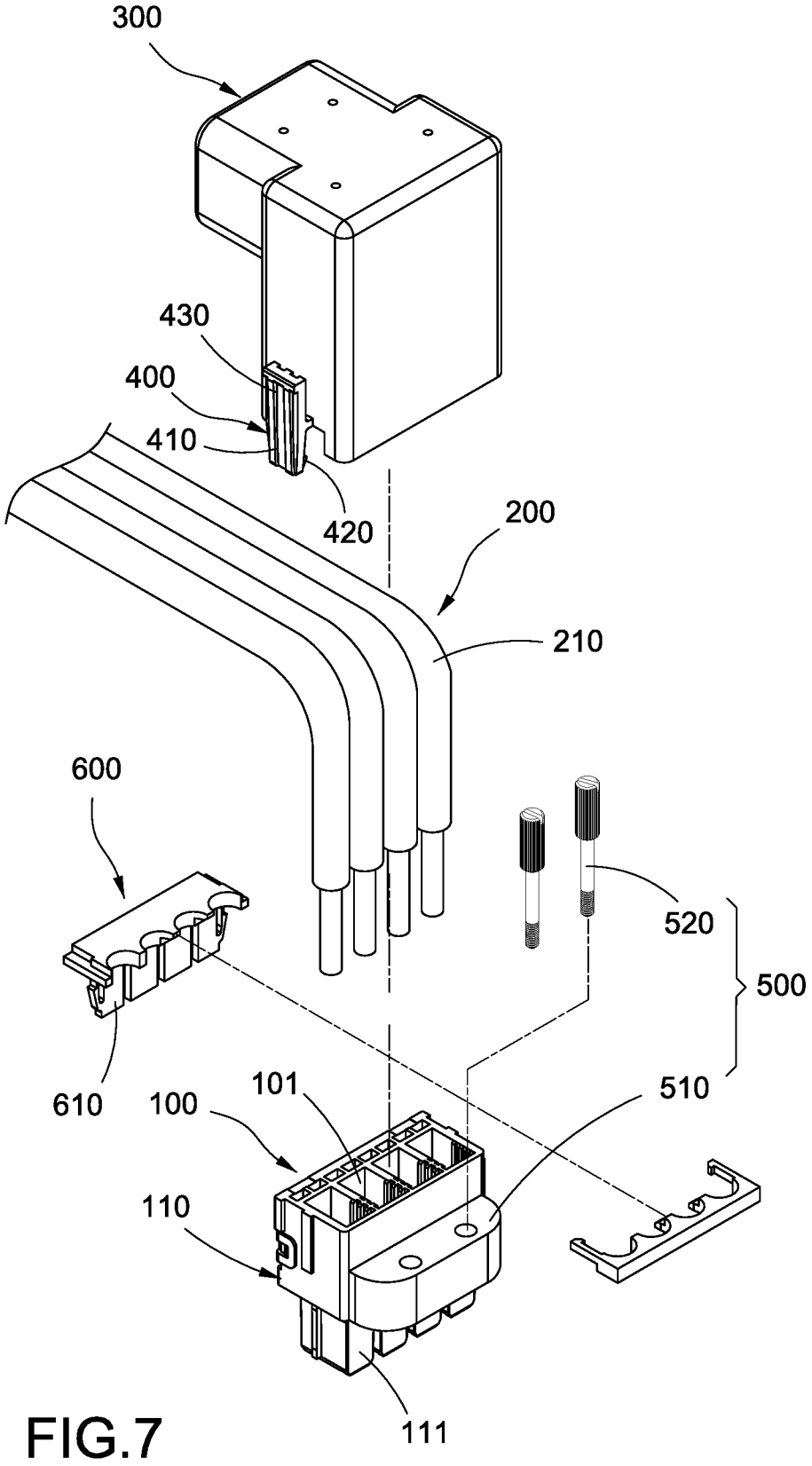
FIG. 7 is a perspective schematic view of the power plug of the second embodiment of the present invention.

Please refer to FIG. 6 and FIG. 7. The second embodiment of the present invention provides a power plug including an electrical connector 100, a plurality of cables 200, an insulation sleeve 300, at least one latch member 400 and at least one fastener 500. The electrical connector 100 has an insulation seat 110 preferably made of, but not limited to, plastic. One end of the insulation seat 110 has a coupling portion 111 and a plurality of wiring holes 101 are defined on the other end of the insulation seat 110 opposite to the coupling portion 111. Each of the cables 200 has one end inserted in each of the corresponding wiring holes 101 respectively.

The insulation seat 110 which has inserted the cables 200 is placed in a mold and an insulation sleeve 300 is formed thereon by injection molding. Thus, the insulation sleeve 300 covers the junction of the electrical connector 100 and each of the cables 200. The coupling portion 111 protrudes out of the insulation sleeve 300, and each cable 200 is extended out the insulation sleeve 300 separately. According to demands of using, the cables 200 can be bended to form a corner 210, and the corner 210 is shaped and covered by the insulation sleeve 300. Moreover, in the present embodiment, the power plug of the present invention further includes a fixture 600. The fixture 600 is extended to form a tenon 610. The tenon 610 is inserted in the insulation base 110 to fix the fixture 600 to the electrical connector 100, and the fixture 600 clamps each of the cables 200. The fixture 600 can be used to fix the junctions of the cables 200 and the insulation base 110 in advance before forming the insulation sleeve 300, and then the insulation sleeve 300 can be formed by injection molding. In addition, the insulation sleeve 300 covers the fixture 600.

The latch member 400 is disposed corresponding to the side of the electrical connector 100. In the present embodiment, a pair of identical latch members 400 are provided corresponding to the opposite sides of the electrical connector 100, however, the quantity of latch members 400 is not limited in the present invention. The fastener 500 is disposed corresponding to at least the other side of the electrical connector 100 that is not provided with a latch member 400, and the quantity of fasteners 500 is not limited in the present invention. In the embodiment, the power plug of the present invention has the fastener 500 disposed on the side of the electrical connector 100 and the latch member 400 connected to the side of the insulation sleeve 300.

Specifically, each fastener 500 includes a base 510 and a screw 520 penetrating the base 510, and the base 510 is formed on the side of the insulation sleeve 300. When the insulation base 110 is inserted in the corresponding socket, the screw 520 can be locked to the socket or an adjacent structure near the socket to fix the electrical connector 100.

Specifically, the latch member 400 includes a resilience arm 410. One end of the resilience arm 410 is connected to the side of the insulation sleeve 300, and rest parts of the resilience arm 410 are spaced from the side of the electrical connector 100, and a hook 420 is formed at the other side of the resilience arm 410. When the insulation base 110 is inserted in the corresponding socket, the hook 420 of the latch member 400 can be fastened to the socket to fix the electrical connector 100. Moreover, the resilience arm 410 can be extended to form a push handle 430 for users to push. When the push handle 430 is pushed, the resilience arm 410 can be driven to release the hook 420.

Figure 8:
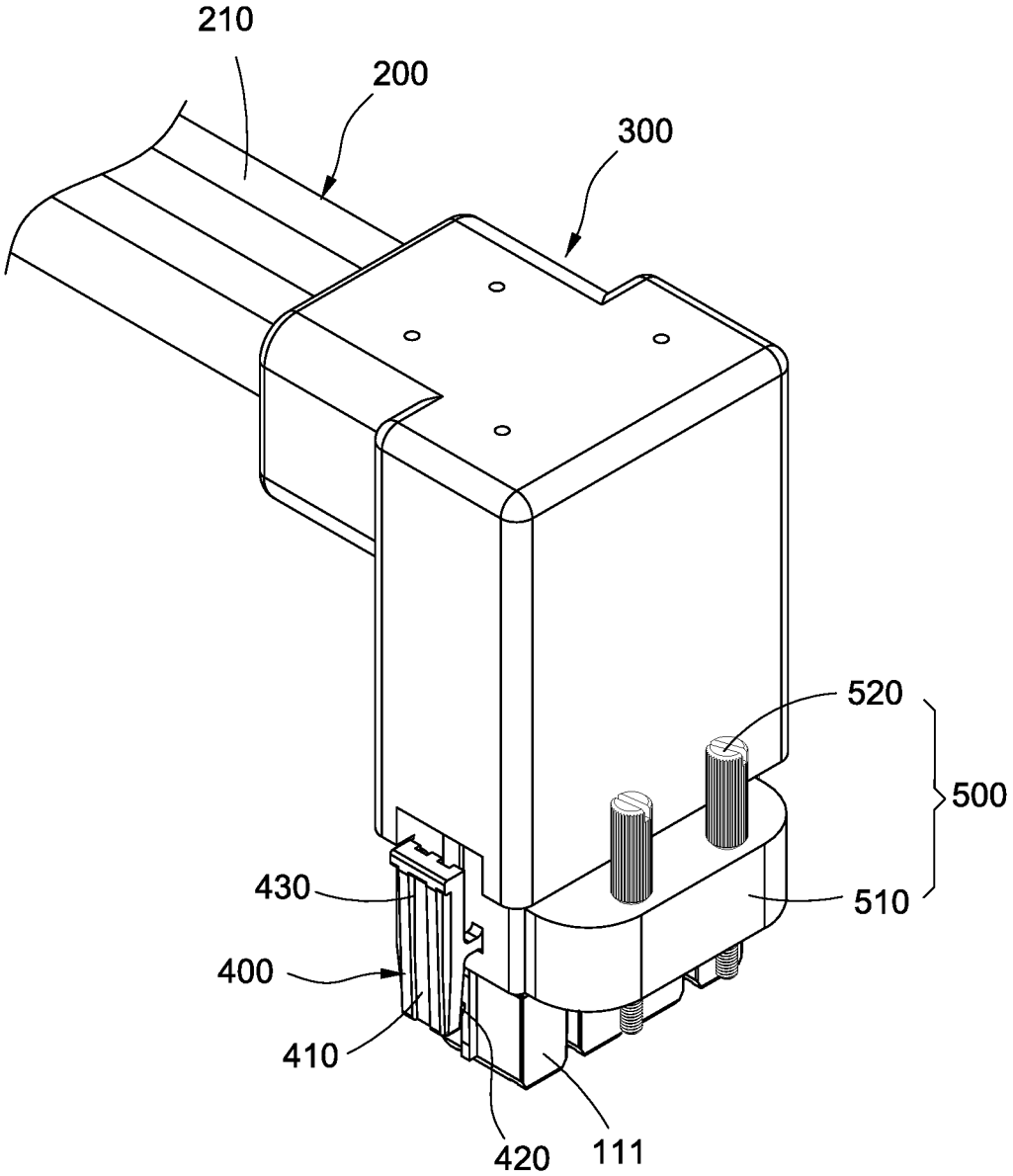
FIG. 8 is a perspective explosion schematic view of the power plug of the third embodiment of the present invention.
Figure 9:
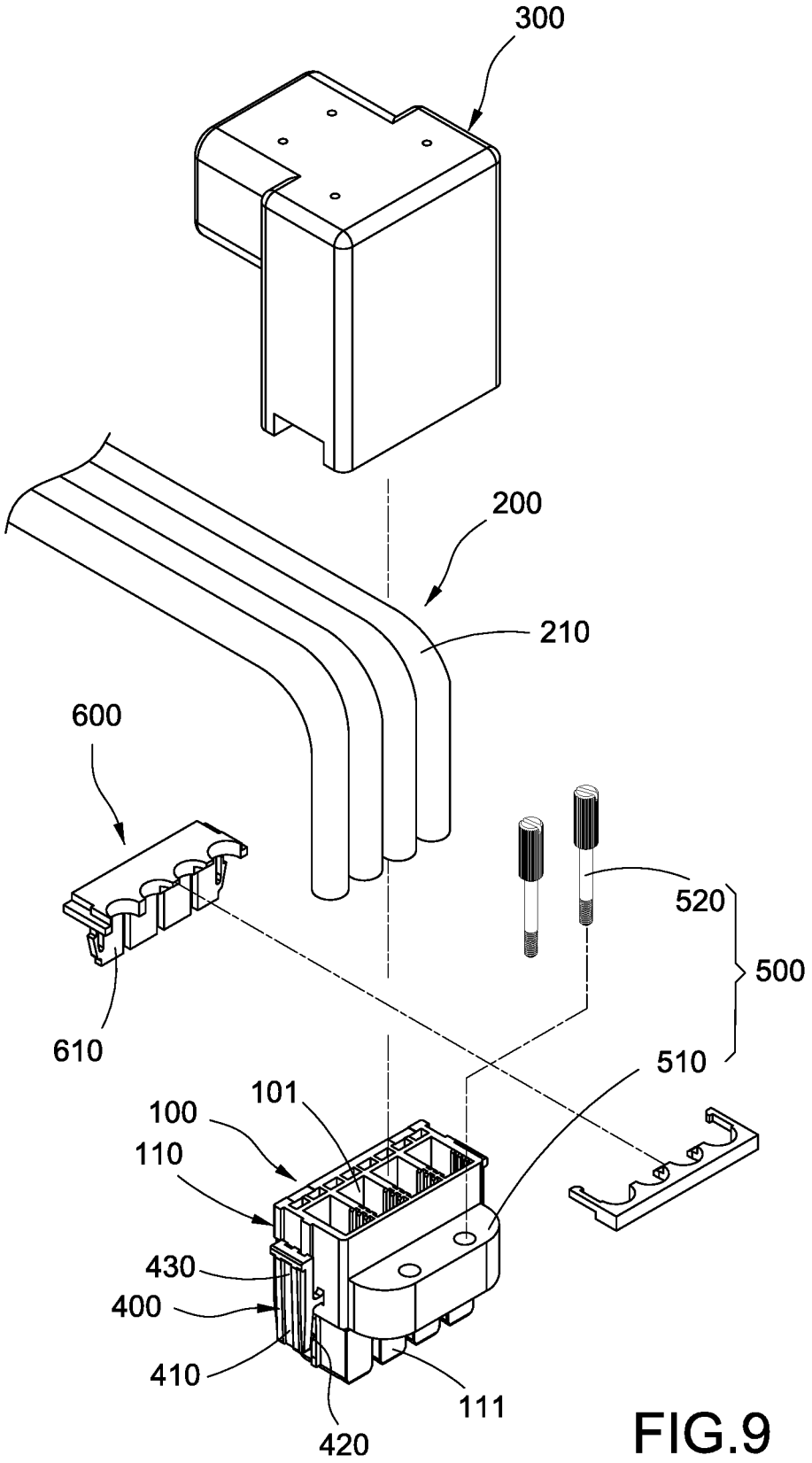
FIG. 9 is a perspective schematic view of the power plug of the third embodiment of the present invention.

Please also refer to FIG. 8 and FIG. 9. The third embodiment of the present invention provides a power plug including an electrical connector 100, a plurality of cables 200, an insulation sleeve 300, at least one latch member 400 and at least one fastener 500. The electrical connector 100 has an insulation seat 110 preferably made of, but not limited to, plastic. One end of the insulation seat 110 has a coupling portion 111 and a plurality of wiring holes 101 are defined on the other end of the insulation seat 110 opposite to the coupling portion 111. Each of the cables 200 has one end inserted in each of the wiring holes 101 respectively.

The insulation seat 110 which has inserted the cables 200 is placed in a mold and an insulation sleeve 300 is formed thereon by injection molding. Thus, the insulation sleeve 300 covers the junction of the electrical connector 100 and each of the cables 200. The coupling portion 111 protrudes out of the insulation sleeve 300, and each cable 200 is extended out the insulation sleeve 300. According to demands of using, the cables 200 can be bended to form a corner 210, and the corner 210 is shaped and covered by the insulation sleeve 300. Moreover, in the present embodiment, the power plug of the present invention further includes a fixture 600. The fixture 600 is extended to form a tenon 610. The tenon 610 is inserted in the insulation base 110 to fix the fixture 600 to the electrical connector 100, and the fixture 600 clamps each of the cables 200. The fixture 600 can be used to fix the junctions of the cables 200 and the insulation base 110 in advance before forming the insulation sleeve 300, and then the insulation sleeve 300 can be formed by injection molding. In addition, the insulation sleeve 300 covers the fixture 600.

The latch member 400 is disposed corresponding to the side of the electrical connector 100. In the present embodiment, a pair of identical latch members 400 are provided corresponding to the opposite sides of the electrical connector 100, however, the quantity of latch members 400 is not limited in the present invention. The fastener 500 is disposed corresponding to at least the other side of the electrical connector 100 that is not provided with a latch member 400, and the quantity of fasteners 500 is not limited in the present invention. In the embodiment, the power plug of the present invention has the latch member 400 connected to the side of the electrical connector 100 and the fastener 500 disposed on the side of the electrical connector 100.

Specifically, each fastener 500 includes a base 510 and a screw 520 penetrating the base 510, and the base 510 is formed on the side of the electrical connector 100. When the insulation base 110 is inserted in the corresponding socket, the screw 520 can be locked to the socket or an adjacent structure near the socket to fix the electrical connector 100.

Specifically, the latch member 400 includes a resilience arm 410. One end of the resilience arm 410 is connected to the side of the electrical connector 100, and rest parts of the resilience arm 410 are spaced from the side of the electrical connector 100, and a hook 420 is formed at the other side of the resilience arm 410. When the insulation base 110 is inserted in the corresponding socket, the hook 420 of the latch member 400 can be fastened to the socket to fix the electrical connector 100. Moreover, the resilience arm 410 can be extended to form a push handle 430 for users to push. When the push handle 430 is pushed, the resilience arm 410 can be driven to release the hook 420.

Figure 10:
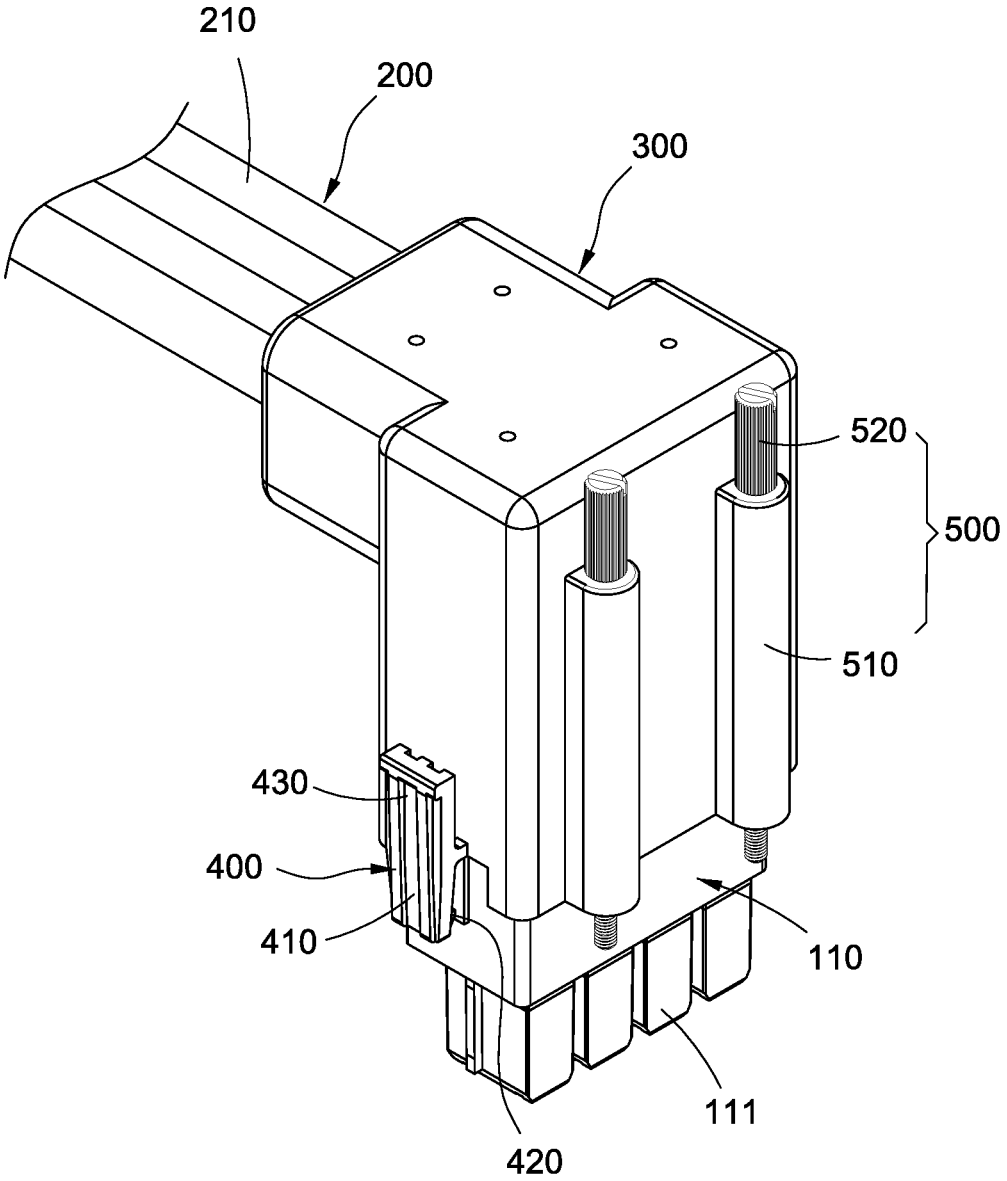
FIG. 10 is a perspective explosion schematic view of the power plug of the fourth embodiment of the present invention.
Figure 11:
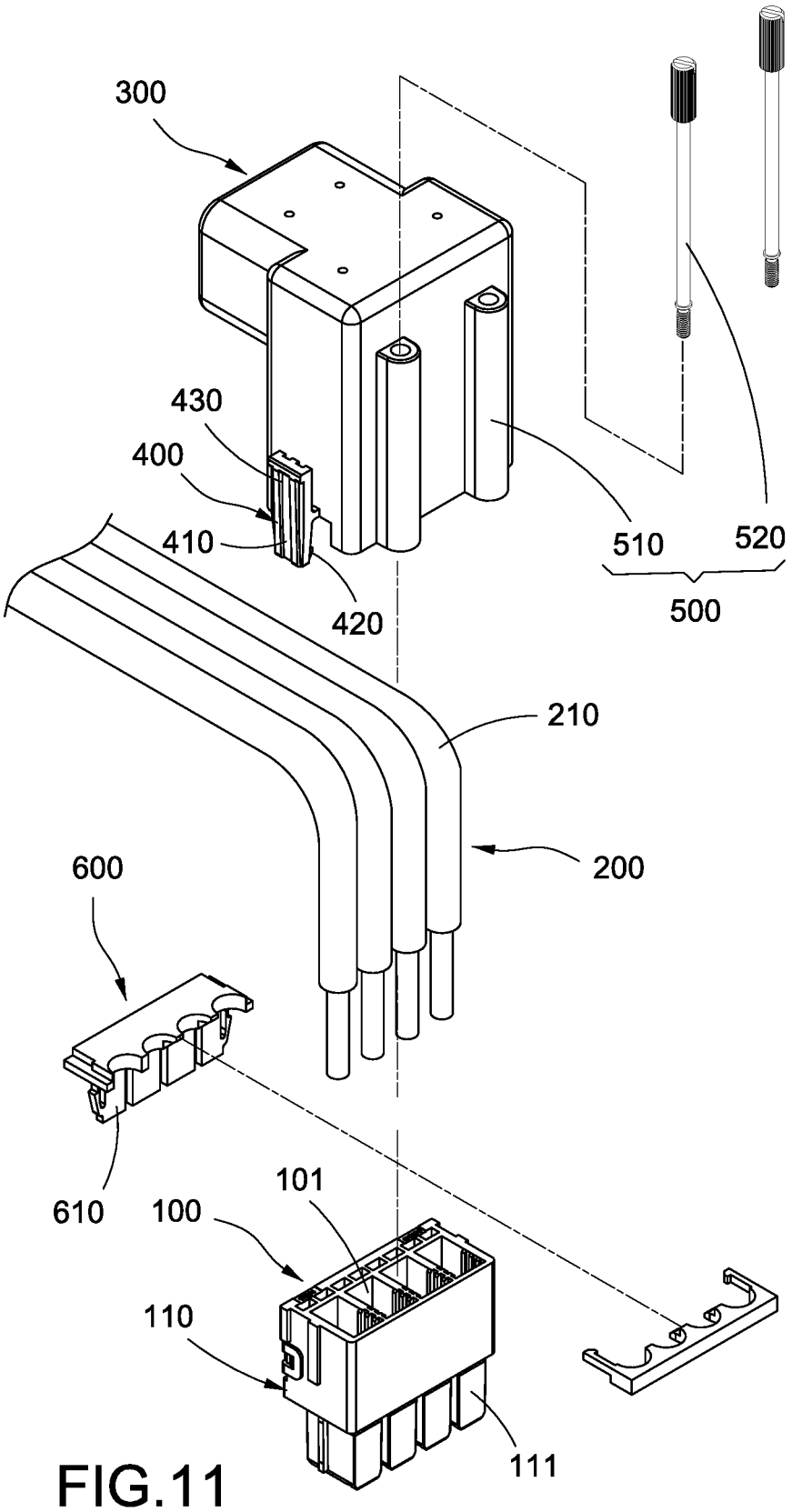
FIG. 11 is a perspective schematic view of the power plug of the fourth embodiment of the present invention.

Please refer to FIG. 10 to FIG. 11. The fourth embodiment of the present invention provides a power plug including an electrical connector 100, a plurality of cables 200, an insulation sleeve 300, at least one latch member 400 and at least one fastener 500. The electrical connector 100 has an insulation seat 110 preferably made of, but not limited to, plastic. One end of the insulation seat 110 has a coupling portion 111 and a plurality of wiring holes 101 are defined on the other end of the insulation seat 110 opposite to the coupling portion 111. Each of the cables 200 has one end inserted in each of the wiring holes 101 respectively.

The insulation seat 110 which has inserted the cables 200 is placed in a mold and an insulation sleeve 300 is formed thereon by injection molding. Thus, the insulation sleeve 300 covers the junction of the electrical connector 100 and each of the cables 200, and the coupling portion 111 protrudes out of the insulation sleeve 300 and each cable 200 is extended out the insulation sleeve 300. According to demands of using, the cables 200 can be bended to form a corner 210, and the corner 210 is shaped and covered by the insulation sleeve 300. Moreover, in the present embodiment, the power plug of the present invention further includes a fixture 600. The fixture 600 is extended to form a tenon 610. The tenon 610 is inserted in the insulation base 110 to fix the fixture 600 to the electrical connector 100, and the fixture 600 clamps each of the cables 200. The fixture 600 can be used to fix the junctions of the cables 200 and the insulation base 110 in advance before forming the insulation sleeve 300, and then the insulation sleeve 300 can be formed by injection molding. In addition, the insulation sleeve 300 covers the fixture 600.

The latch member 400 is disposed corresponding to the side of the electrical connector 100. In the present embodiment, a pair of identical latch members 400 are provided corresponding to the opposite sides of the electrical connector 100, however, the quantity of latch members 400 is not limited in the present invention. The fastener 500 is disposed corresponding to at least the other side of the electrical connector 100 that is not provided with a latch member 400, and the quantity of fasteners 500 is not limited in the present invention. In the embodiment, the power plug of the present invention has the latch member 400 connected to the side of the insulation sleeve 300 and the fastener 500 disposed on the side of the insulation sleeve 300.

Specifically, the fastener 500 includes a base 510 and a screw 520 penetrating the base 510, and the base 510 is formed on the side of the insulation sleeve 300. When the insulation base 110 is inserted in the corresponding socket, the screw 520 can be locked to the socket or an adjacent structure near the socket to fix the electrical connector 100.

Specifically, the latch member 400 includes a resilience arm 410. One end of the resilience arm 410 is connected to the side of the insulation sleeve 300, and rest parts of the resilience arm 410 are spaced from the side of the electrical connector 100, and a hook 420 is formed at the other side of the resilience arm 410. When the insulation base 110 is inserted in the corresponding socket, the hook 420 of the latch member 400 can be fastened to the socket to fix the electrical connector 100. Moreover, the resilience arm 410 can be extended to form a push handle 430 for users to push. When the push handle 430 is pushed, the resilience arm 410 can be driven to release the hook 420.

The power plug of the present invention has formed the insulation sleeve 300 by injection molding to fix and cover the junctions of the electrical connector 100 and the cables for insulation. At the same time, the bend of the cable 200 can be fixed by the insulation sleeve 300.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A power plug for coupling a socket, the power plug including:

an electrical connector, one end of the electrical connector having a coupling portion and a plurality of wiring holes defined on the other end of the electrical connector opposite to the coupling portion;

a plurality of cables, each of the cables having one end inserted in each of the wiring holes;

an insulation sleeve covering a junction of the electrical connector and each of the cables, and the coupling portion protruding out of the insulation sleeve, and the other end of each of the cables protruding out of the insulation sleeve separately;

at least one latch member for fastening with the socket, the latch member being disposed corresponding to one side of the electrical connector; and at least one fastener for locking the socket, the fastener being disposed corresponding to another side of the electrical connector, wherein the latch member is connected to the side of the electrical connector.

2. The power plug according to claim 1, wherein the fastener is disposed on one side of the insulation sleeve.

3. The power plug according to claim 2, wherein the fastener includes a base and a screw penetrating the base, and the base is formed on the side of the electrical connector.

4. The power plug according to claim 2, wherein the latch member includes a resilience arm; one end of the resilience arm is connected to the side of the electrical connector and rest parts of the resilience arm are spaced from the side of the electrical connector, and a hook is formed at the other side of the resilience arm.

5. A power plug for coupling a socket, the power plug including:

an electrical connector, one end of the electrical connector having a coupling portion and a plurality of wiring holes defined on the other end of the electrical connector opposite to the coupling portion;

a plurality of cables, each of the cables having one end inserted in each of the wiring holes;

an insulation sleeve covering a junction of the electrical connector and each of the cables, and the coupling portion protruding out of the insulation sleeve, and the other end of each of the cables protruding out of the insulation sleeve separately;

at least one latch member for fastening with the socket, the latch member being disposed corresponding to one side of the electrical connector; and at least one fastener for locking the socket, the fastener being disposed corresponding to another side of the electrical connector, wherein the fastener is disposed on the side of the electrical connector and the latch member connects one side of the insulation sleeve.

6. The power plug according to claim 5, wherein the fastener includes a base and a screw penetrating the base, and the base is formed on the side of the insulation sleeve.

7. The power plug according to claim 5, wherein the latch member includes a resilience arm; one end of the resilience arm is connected to the side of the insulation sleeve and rest parts of the resilience arm are spaced from the side of the electrical connector, and a hook is formed at the other side of the resilience arm.

8. The power plug according to claim 1, wherein the fastener is disposed on one side of the electrical connector.

9. The power plug according to claim 8, wherein each fastener includes a base and a screw penetrating the base, and the base is formed on the side of the electrical connector.

10. The power plug according to claim 8, wherein the latch member includes a resilience arm; one end of the resilience arm is connected to the side of the electrical connector and rest parts of the resilience arm are spaced from the side of the electrical connector, and a hook is formed at the other side of the resilience arm.

11. The power plug according to claim 1, further including a fixture, wherein the fixture clamps the electrical connector and each of the cables.

12. The power plug according to claim 11, wherein the insulation sleeve covers the fixture.

13. The power plug according to claim 1, wherein each of the cables is bent and formed a corner, and each of the corners is shaped and covered by the insulation sleeve.

14. The power plug according to claim 5, further including a fixture, wherein the fixture clamps the electrical connector and each of the cables.

15. The power plug according to claim 14, wherein the insulation sleeve covers the fixture.

16. The power plug according to claim 5, wherein each of the cables is bent and formed a corner, and each of the corners is shaped and covered by the insulation sleeve.

* * * * *